US007473333B2

(12) United States Patent
Urscheler et al.

(10) Patent No.: US 7,473,333 B2
(45) **Date of Patent: *Jan. 6, 2009**

(54) PROCESS FOR MAKING COATED PAPER OR PAPERBOARD

(75) Inventors: Robert Urscheler, Horgen (CH); Pekka J. Salminen, Galgenin (CH); Jamel F. Attai, Midland, MI (US); John A. Roper, III, Midland, MI (US)

(73) Assignee: Dow Global Technologies Inc., Midland, MI (US)

( * ) Notice: Subject to any disclaimer, the term of this patent is extended or adjusted under 35 U.S.C. 154(b) by 435 days.

This patent is subject to a terminal disclaimer.

(21) Appl. No.: 10/687,322

(22) Filed: Oct. 16, 2003

(65) Prior Publication Data

US 2005/0039871 A1 Feb. 24, 2005

Related U.S. Application Data

(63) Continuation-in-part of application No. 10/273,865, filed on Oct. 17, 2002, now abandoned, which is a continuation-in-part of application No. 10/257,172, filed on Apr. 12, 2002, now Pat. No. 7,425,246.

(51) Int. Cl.
*D21H 19/82* (2006.01)
*B05D 1/30* (2006.01)

(52) U.S. Cl. ..... 162/137; 162/158; 162/169; 162/164.1; 162/168.1; 162/179; 162/177; 162/181.1; 162/181.4; 162/181.6; 162/181.8; 427/402; 427/420; 427/411

(58) Field of Classification Search ..... 162/135–137, 162/158, 164.1, 168.1, 169, 162, 177, 179, 162/181.1–181.2, 181.4, 181.6, 181.8; 427/420, 427/402, 391, 361, 411, 407.1; 428/195.1, 428/340–341

See application file for complete search history.

(56) References Cited

U.S. PATENT DOCUMENTS

| | | | | |
|---|---|---|---|---|
| 2,761,419 | A | 2/1956 | Mercier et al. | |
| 3,005,440 | A | 10/1961 | Padday | |
| 3,419,203 | A | 12/1968 | Amend, Jr. | |
| 3,436,022 | A | 4/1969 | Ernst | 239/455 |
| 3,508,947 | A | 4/1970 | Huges | 117/34 |
| 3,632,374 | A | 1/1972 | Greiller | |
| 4,001,024 | A | 1/1977 | Dittman et al. | |

(Continued)

FOREIGN PATENT DOCUMENTS

| | | |
|---|---|---|
| BE | 852751 | 9/1977 |

(Continued)

OTHER PUBLICATIONS

Derwent Abstract for DD 221722A, May 2, 1985, K. H. Bergk; (East German Application No. 1984DD-0259266, Jan. 9, 1984).

(Continued)

*Primary Examiner*—José A Fortuna

(57) ABSTRACT

The present invention refers to a method of producing a coated paper or paperboard, but excluding photographic papers, comprising the steps of:

(a) forming a free flowing curtain comprising at least one layer, whereby the composition forming at least one layer of the free flowing curtain has a high shear viscosity of at least about 50 mPa·s, and (b) contacting the curtain with a continuous web substrate of basepaper and paperboard.

34 Claims, 1 Drawing Sheet

U.S. PATENT DOCUMENTS

| | | | | |
|---|---|---|---|---|
| 4,041,897 | A | 8/1977 | Ade | 118/300 |
| 4,109,611 | A | 8/1978 | Fahrni et al. | 118/325 |
| 4,230,743 | A | 10/1980 | Nakamura | |
| 4,358,476 | A | 11/1982 | Zimmer et al. | 427/44 |
| 4,569,863 | A | 2/1986 | Koepke et al. | |
| 4,710,270 | A | 12/1987 | Sunden | |
| 4,975,304 | A | 12/1990 | Kawahara et al. | |
| 5,118,533 | A | 6/1992 | Saji et al. | |
| 5,224,996 | A | 7/1993 | Ghys et al. | |
| 5,234,500 | A | 8/1993 | Korokeyi | |
| 5,236,744 | A * | 8/1993 | Suga et al. | 427/420 |
| 5,238,534 | A | 8/1993 | Manning | |
| 5,270,355 | A | 12/1993 | Kawano et al. | |
| 5,290,672 | A * | 3/1994 | Dunk | 430/538 |
| 5,391,401 | A | 2/1995 | Blake et al. | 427/420 |
| 5,393,571 | A * | 2/1995 | Suga et al. | 427/420 |
| 5,447,753 | A | 9/1995 | Noda et al. | |
| 5,505,995 | A | 4/1996 | Leonard | |
| 5,506,000 | A | 4/1996 | Leonard | |
| 5,641,544 | A * | 6/1997 | Melancon et al. | 427/331 |
| 5,643,992 | A | 7/1997 | Northey | 524/501 |
| 5,654,039 | A | 8/1997 | Wenzel et al. | |
| 5,733,608 | A | 3/1998 | Kessel et al. | 427/547 |
| 5,773,093 | A * | 6/1998 | Mitani et al. | 427/420 |
| 5,789,031 | A | 8/1998 | Hirabayashi et al. | |
| 5,861,195 | A | 1/1999 | Bhave et al. | |
| 5,876,815 | A * | 3/1999 | Sandstrom et al. | 428/36.8 |
| 5,885,659 | A | 3/1999 | Takahashi et al. | |
| 6,060,206 | A | 5/2000 | Hanaki et al. | |
| 6,086,954 | A * | 7/2000 | Kaufmann et al. | 427/288 |
| 6,099,913 | A | 8/2000 | Clarke et al. | 427/420 |
| 6,103,313 | A | 8/2000 | Clarke et al. | 427/420 |
| 6,106,902 | A | 8/2000 | Koskinen et al. | |
| 6,120,784 | A | 9/2000 | Snyder, Jr. | |
| 6,146,690 | A | 11/2000 | Kustermann | |
| 6,214,416 | B1 | 4/2001 | Sakagami | |
| 6,294,023 | B1 | 9/2001 | Katagiri et al. | |
| 6,335,085 | B1 | 1/2002 | Asano et al. | |
| 6,358,306 | B1 | 3/2002 | Hanada et al. | |
| 6,419,987 | B1 * | 7/2002 | Bauer et al. | 427/302 |
| 6,458,413 | B1 | 10/2002 | Hirabayashi et al. | |
| 6,479,107 | B2 | 11/2002 | Katagiri et al. | |
| 6,548,120 | B1 | 4/2003 | Wittosch et al. | |
| 6,558,740 | B1 | 5/2003 | Santo et al. | |
| 6,562,441 | B1 | 5/2003 | Maeda et al. | 428/195 |
| 6,579,569 | B2 | 6/2003 | Bermel et al. | |
| 6,607,786 | B2 * | 8/2003 | Katagiri et al. | 427/314 |
| 6,746,718 | B2 | 6/2004 | Yokota | |
| 6,780,455 | B2 * | 8/2004 | Clarke et al. | 427/8 |
| 6,824,828 | B2 * | 11/2004 | Su et al. | 427/356 |
| 6,982,003 | B2 | 1/2006 | Gueggi et al. | |
| 7,172,793 | B2 * | 2/2007 | Cohu | 427/407.1 |
| 7,208,068 | B2 * | 4/2007 | Nisogi et al. | 162/135 |
| 7,364,774 | B2 * | 4/2008 | Urscheler et al. | 427/420 |
| 7,425,246 | B2 * | 9/2008 | Urscheler | 162/137 |
| 2001/0008653 | A1 | 7/2001 | Katagiri et al. | |
| 2001/0016231 | A1 | 8/2001 | Bower | 427/420 |
| 2002/0009549 | A1 | 1/2002 | Ogawa | |
| 2002/0066404 | A1 | 6/2002 | Ueberschar et al. | 118/261 |
| 2002/0160121 | A1 | 10/2002 | Katagiri et al. | 427/420 |
| 2003/0003197 | A1 | 1/2003 | Berlin et al. | 426/106 |
| 2003/0064162 | A1 * | 4/2003 | Clarke et al. | 427/420 |
| 2003/0118739 | A1 | 6/2003 | Li et al. | 427/421 |
| 2003/0149115 | A1 | 8/2003 | Garces et al. | |
| 2003/0180470 | A1 | 9/2003 | Oki et al. | |
| 2003/0188839 | A1 | 10/2003 | Urscheler | |
| 2003/0190432 | A1 | 10/2003 | Yokota et al. | 427/420 |
| 2003/0194501 | A1 | 10/2003 | Urscheler et al. | |
| 2003/0235657 | A1 | 12/2003 | Schweizer et al. | 427/420 |
| 2004/0013815 | A1 * | 1/2004 | Gros | 427/558 |
| 2004/0052953 | A1 * | 3/2004 | Cohu | 427/402 |
| 2004/0121079 | A1 | 6/2004 | Urscheler et al. | |
| 2004/0121080 | A1 | 6/2004 | Urscheler et al. | |
| 2004/0166244 | A1 | 8/2004 | Ueberschar et al. | |
| 2003/0265496 | | 12/2004 | Gueggi | |
| 2004/0253385 | A1 | 12/2004 | Gueggi | |
| 2005/0025889 | A1 * | 2/2005 | Yago | 427/314 |
| 2005/0039871 | A1 * | 2/2005 | Urscheler et al. | 162/135 |
| 2005/0100677 | A1 * | 5/2005 | Su et al. | 427/420 |
| 2006/0005933 | A1 * | 1/2006 | Okomori et al. | 162/137 |
| 2006/0051528 | A1 | 3/2006 | Ogino | |
| 2006/0137841 | A1 * | 6/2006 | Chatani et al. | 162/135 |
| 2006/0182893 | A1 * | 8/2006 | Fermin et al. | 427/420 |
| 2007/0231478 | A1 * | 10/2007 | Watanabe et al. | 427/162 |
| 2008/0096002 | A1 * | 4/2008 | Leskela et al. | 428/311.11 |
| 2008/0107912 | A1 * | 5/2008 | Barcock | 428/500 |

FOREIGN PATENT DOCUMENTS

| | | | |
|---|---|---|---|
| DE | 19735980 | A1 * | 2/1998 |
| EP | 0919395 | | 6/1999 |
| EP | 969147 | A2 * | 1/2000 |
| EP | 1249533 | | 10/2002 |
| EP | 1249533 | A1 * | 10/2002 |
| EP | 1319747 | A2 * | 6/2003 |
| EP | 1411168 | A1 * | 4/2004 |
| EP | 1416087 | A1 * | 5/2004 |
| EP | 1416088 | A2 * | 5/2004 |
| GB | 838392 | | 6/1960 |
| JP | 03-222293 | B | 10/1991 |
| JP | 05-106198 | A | 4/1993 |
| JP | 1993/117996 | | 5/1993 |
| JP | 05-247890 | A | 9/1993 |
| JP | 06-346400 | A | 12/1994 |
| JP | 07-300796 | A | 11/1995 |
| JP | 08-310110 | | 11/1996 |
| JP | 11-192777 | | 5/1998 |
| JP | 2000-45200 | | 7/1998 |
| JP | 10-328613 | | 12/1998 |
| JP | 11-192777 | | 7/1999 |
| JP | 11192777 | | 7/1999 |
| JP | 2000/070810 | A | 3/2000 |
| JP | 2000-070810 | A | 3/2000 |
| JP | 2000-153214 | A | 6/2000 |
| JP | 03-222221 | B | 10/2001 |
| JP | 2001-300386 | | 10/2001 |
| JP | 2001/300386 | | 10/2001 |
| JP | 2004148307 | A * | 5/2004 |
| JP | 2004154773 | A * | 6/2004 |
| JP | 2005120502 | A * | 5/2005 |
| WO | WO-92/11095 | | 7/1992 |
| WO | WO 98/45054 | | 10/1998 |
| WO | WO-98/47630 | | 10/1998 |
| WO | WO 01/54828 | | 8/2001 |
| WO | WO 0176884 | A1 * | 10/2001 |
| WO | WO 02/053838 | | 7/2002 |
| WO | WO 02/066739 | | 8/2002 |
| WO | WO 02/081576 | | 10/2002 |
| WO | WO 02/084029 | | 10/2002 |
| WO | WO 2004/035931 | | 4/2004 |
| WO | WO-2004/101691 | A2 | 11/2004 |
| WO | 2006070065 | | 6/2006 |

OTHER PUBLICATIONS

Schweizer, Peter M."Premetered coating processes, Advantages and applications", *Coating,* 1998.

Alleborn; Norbert et al., "High-speed curtain coating of paper", *PTS-Coating Symposium,* 2001.

Miyamoto, K. and Yoshinobu Katagiri, "Curtain Coating", *Liquid Film Coating,* 1997, 463-494.

Triantafillopoulos, Nick et al., "Operational Issues in High-speed Curtain Coating of Paper", 2001.

Derwent Abstract 1992-429056, Japanese Patent 04-325586, Wakata kazuyoshi et al., Nov. 13, 1992.

Derwent Abstract 1992-429948, Japanese Patent 04-327296, Higuchi masahiro et al., Nov. 16, 1992.
Derwent Abstract 1995-196793, Japanese Patent 07-113068, Moroishi Yutaka et al., May 2, 1995.
Derwent Abstract 1999-063934, Japanese Patent 10-309506, Kashiwada Hirotaka et al., Nov. 24, 1998.
Derwent Abstract 1992-170429, Japanese Patent 04100998, Apr. 2, 1992.
Derwent Abstract 1993-055029, Japanese Patent 05004441, Sugiyama Takeo, Jan. 14, 1993.
Derwent Abstract 1994-222740, Japanese Patent 6158591, Jun. 7, 1994.
Derwent Abstract 1995-009867, Japanese Patent 6294099, Arai Takao et al., Oct. 21, 1994.
Derwent Abstract 1995-204515, Japanese Patent 07119083, May 9, 1995.
Derwent Abstract 2001-274380, Japanese Patent 2001/018526, Jul. 7, 1999.
Derwent Abstract 2001-239141, Japanese Patent 2001/038284, Yanagisawa Kenji et al., Jul. 30, 1999.
Derwent Abstract 2001-274380, Japanese Patent 2001/138631, Maruyama et al., May 22, 2001.
Derwent Abstract 2002-003151, Japanese Patent 2001/252612, Sunakawa Tomohide, Sep. 18, 2001.
Derwent Abstract 2002-044693, Japanese Patent 2001/262499, Yamane Kengo, Sep. 26, 2001.
Derwent Abstract 2002-296627, Japanese Patent 2001/293956, Shiraishi et al., Oct. 23, 2001.
Derwent Abstract 2003-357679, Japanese Patent 2002/307804, Yokota Yasuro, Oct. 23, 2002.
Derwent Abstract 2003-516007, Japanese Patent 2002/323734, Nagahama Masaru et al., Nov. 8, 2002.
Derwent Abstract 2000-642699, Japanese Patent 2000/262962, Ishiguro Naoyuki, Sep. 26, 2000.
Derwent Abstract 2002-041276, International Patent 200176884, Shiraishi et al., Oct. 18, 2001.
Stephan F. Kistler and Peter M. Schweizer; Liquid Film Coating Scientific Principles and Their Technological Implications; Chapman & Hall; New York; 1997; Chapter 11; "Slot Coating"; pp. 401-536. (Kistler).
Stephan F. Kistler and Peter M. Schweizer; Liquid Film Coating Scientific Principles and Their Technological Implications; Chapman & Hall; New York; 1997; Chapter 15; "Control and Optimization of Coating Processes"; pp. 735-768.
Kistler, Stephan F., et al., "Slot Coating", Liquid Film Coating Scientific Principles and Their Technologiecal Implications, 1997, pp. 401-536, Chapter 11, Chapman & Hall, New York.
Kistler, Stephan F., et al., "Control and Optimization of Cating Processes", Liquid Film Coating Scientific Principles and Their Technological Implications, 1997, pp. 735-768, Chapter 15, Chapman & Hall, New York.
Triantafillopoulos, Nick, et al., "Operational Issues In High-Speed Curtain Coating of Paper," 2001 TAPPI Coating and Graphic Arts Conference and Trade Fair (May 6-9, 2001), pp. 251-263, San Diego, CA, USA.
Schweizer, Peter M., "Simultaneous Multilayer Coating Technologies: Attractiveness and Limitations," TAPPI Coating Conference 2002, (May 5-8, 2002), pp. 1-14, Orlando, FL, USA.
Urscheler, Robert, et al., "Key Attributes and Opportunities of Multilayer Curtain Coating for Paper," 2005 TAPPI Coating Conference and Exhibit, (Apr. 17-20, 2005) pp. 1-16 (including 23 pgs of slides).
Alleborn, Norbert, et al., "Anwendung der Vorhangbeschichtung zur Oberflachenveredelung von Bauelementen aus Beton," *Chemie Ingenieur Technik,* 77, No. 1-2 (2005), , pp. 84-89.
D. Meck, et al., "Non-impact coating in the curtain coater", 20. Streicherel-Symposium 2001, p. 34-1 to 34-6, Germany (German language with English language abstract).

* cited by examiner

PROCESS FOR MAKING COATED PAPER OR PAPERBOARD

CROSS REFERENCE TO RELATED APPLICATIONS

This application is a continuation-in-part of U.S. application Ser. No. 10/273,865, filed Oct. 17, 2002, now abandoned, which is a continuation-in-part of U.S. application Ser. No. 10/257,172, filed Apr. 12, 2002, now U.S. Pat. No. 7,425,246 B2.

BACKGROUND OF THE INVENTION

The present invention relates to a method of producing coated paper or paperboard. In addition, the present invention relates to a method of applying coating compositions having a high viscosity under conditions of high shear to substrates.

In the manufacture of printing paper pigmented coating compositions, which have a considerably higher solids content and viscosity than photographic solutions or emulsions, typically are applied, for example, by blade type, bar (rod) type or reverse-roll (film) type coating methods at high line speeds of above 1000 m/min. Any or all of these methods are commonly employed to sequentially apply pigmented coatings to a moving paper or paperboard surface.

However, each of these application methods inherently has its own set of problems that can result in an inferior coated surface quality. In the case of the blade type coating method, the lodgment of particles under the blade can result in streaks in the coating layer, which lowers the quality of the coated paper or paperboard. In addition, the high pressure that must be applied to the blade to achieve the desired coating weight places a very high stress on the substrate and can result in breakage of the substrate web, resulting in lowered production efficiency. Moreover, since the pigmented coatings are highly abrasive, the blade must be replaced regularly in order to maintain the evenness of the coated surface. Also, the distribution of the coating on the surface of the paper or paperboard substrate is affected by the surface irregularities of the substrate. An uneven distribution of coating across the paper or paperboard surface can result in a dappled or mottled surface appearance that can lead to an inferior printing result.

The bar (rod) type coating method is limited as to the solids content and viscosity of the pigmented coating color that is to be applied. Pigmented coatings applied by the bar type coating method are typically lower in solids content and viscosity than pigmented coating colors applied by the blade type method. Accordingly, for the bar type coating method it is not possible to freely change the amount of coating that can be applied to the surface of the paper or paperboard substrate. Undesirable reductions in the quality of the surface of the coated paper or paperboard can result when the parameters of coating solids content, viscosity and coatweight are imbalanced. Moreover, abrasion of the bar by the pigmented coatings requires that the bar be replaced at regular intervals in order to maintain the evenness of the coated surface.

The roll type (film) coating method is a particularly complex process of applying pigmented coatings to paper and paperboard in that there is a narrow range of operating conditions related to substrate surface characteristics, substrate porosity, coating solids content, and coating viscosity that must be observed for each operating speed and each desired coatweight to be achieved. An imbalance between these variables can lead to an uneven film-split pattern on the surface of the coated paper, which can lead to an inferior printing result, or the expulsion of small droplets of coating as the sheet exits the coating nip. These droplets, if re-deposited on the sheet surface, can lead to an inferior printing result. Moreover, the maximum amount of coating that can be applied to a paper or paperboard surface in one pass using the roll type coating method is typically less than that which can be applied in one pass by the blade or bar type coating methods. This coating weight limitation is especially pronounced at high coating speeds.

A common feature of all these methods is that the amount of coating liquid applied to a paper web, which generally has an irregular surface with hills and valleys, is different depending on whether it is applied to a hill or a valley. Therefore, coating thickness, and thus ink reception properties, will vary across the surface of the coated paper resulting in irregularities in the printed image. Despite their drawbacks, these coating methods are still the dominant processes in the paper industry due to their economics, especially since very high line speeds can be achieved.

All of the aforementioned coating methods have in common that coating compositions having a very high viscosity under conditions of high shear and/or shear-thickening behavior cannot be applied to substrates because such coating compositions lead to unacceptable coating defects such as streaks in the coating layer or failure to meet target coatweights. Moreover, such coating compositions generally exhibit poor water-holding properties coupled with a low immobilization solids content. Coatings with poor water-holding properties generally cannot be coated with the aforementioned coating methods without lowering the coating solids and/or adding water-holding agents. In addition for drying efficiency it is desirable to coat at high coating solids content close to the immobilization solids content. This means that coatings with low immobilization solids and poor water-holding properties are particularly challenging to coat using the aforementioned coating processes.

On the other hand, there is the trend in the paper industry to use engineered pigments that are generally pigments having narrow particle size distributions or morphologies such as high aspect ratios, acicular shapes, or other irregular shapes as well as internal porosity such as found in calcined clay. Engineered pigments hereafter referred to as co-structured pigments, have also been developed. The term "co-structured pigment" should be interpreted in the sense that such pigment is modified by, for example, agglomerating specific particles to other specific particles; one example of these is calcium carbonate particles agglomerated onto talc particles, such a combination being thought to improve specific paper properties such as opacity, gloss and printing properties. Moreover, such pigments lead to improved mechanical properties of the paper.

When engineered pigments are added to a coating composition at a level of greater Than about 20 wt. % the composition typically has a high viscosity under conditions of high shear and/or shear-thickening behavior. This is due to the inability of the pigments to pack into efficient compact structures under conditions of high shear rate. Similar volumetric packing effects at conditions of high shear rate also occur with conventional coating formulations as the solids content approaches the immobilization point. This phenomenon makes it difficult or even impossible to coat such a coating composition on paper or paperboard using the aforementioned coating techniques. Generally speaking, as the viscosity at shear rates greater than 100,000 $s^{-1}$ gets higher than 50 mPa·s, runnability issues become problematic. Coatings with a viscosity above 75 mPa·s are usually considered difficult to run and coatings with viscosity above 100 mPa·s are very difficult to run.

In addition, coatings with shear-thickening behavior are nearly impossible to run on the aforementioned equipment. Shear-thickening behavior is the phenomenon of an increasing viscosity as the shear rate is increased. The shear rate for the onset of shear thickening behavior can vary widely as well as the degree of increase in viscosity with increasing shear. Both aspects of the shear-thickening behavior are important and both aspects are very dependent on the solids content of the coating. For purposes of this invention a shear-thickening coating formulation is defined as one whose viscosity increases by at least 20% over an order of magnitude (factor of 10) change in shear rate for shear rates in excess of 1000 $s^{-1}$.

For some coatings the onset and degree of shear-thickening behavior is an abrupt Transition and represents a severe form of shear-thickening (dilatant) behavior. For the purposes of this invention this behavior will be called Shear Blocking Behavior, and is defined by a coating whose viscosity increases by at least 100% in less than an order magnitude increase in shear rate as measured using the Parallel Plate Viscosity Test. The shear rate for the onset of shear-blocking behavior can vary widely and is very dependent on the solids content of the coating as well as factors such as the particle size distribution of the coating pigments.

Curtain coating is a relatively new coating technique. EP-A 517 223 and Japanese patent applications JP-94-89437, JP-93-311931, JP-93-177816, JP-93-131718, JP-92-298683, JP-92-51933, JP-91-298229, JP-90-217327, and JP-8-310110 disclose the use of curtain coating methods to apply one or more pigmented coating layers to a moving paper surface. More specifically, the prior art relates to:

(i) The curtain coating method being used to apply a single layer of pigmented coating to a basepaper substrate to produce a single-layer-pigmented coating on paper.

(ii) The curtain coating method being used to apply a single priming layer of pigmented coating to a basepaper substrate prior to the application of a single layer of pigmented topcoat applied by a blade type coating process. Thus a multilayer-pigmented coating of paper was achieved by sequential applications of pigmented coating.

(iii) The curtain coating method being used to apply a single topcoating layer of pigmented coating to a basepaper substrate that has previously been primed with a single layer of pigmented precoat that was applied by a blade or a metering roll type coating process. Thus a multilayer-pigmented paper coating was achieved by sequential applications of pigmented coating.

(iv) The curtain coating method being used to apply two single layers of specialized pigmented coating to a basepaper substrate such that the single layers were applied in consecutive processes. Thus a multilayer-pigmented coating of paper was achieved by sequential applications of pigmented coating.

The use of a curtain coating method to apply a single layer of pigmented coating to the surface of a moving web of paper, as disclosed in the prior art discussed above, is stated to offer the opportunity to produce a superior quality coated paper surface compared to that produced by conventional means. However, the sequential application of single layers of pigmented coating using curtain coating techniques is constrained by the dynamics of the curtain coating process. Specifically, lightweight coating applications can only be made at coating speeds below those currently employed by conventional coating processes because at high coating speeds the curtain becomes unstable, and this results in an inferior coated surface. Unfortunately, the application of consecutive single layers of pigmented coatings to paper or paperboard at successive coating stations, whether by any of the above coating methods, remains a capital-intensive process due to the number of coating stations required, the amount of ancillary hardware required, for example, drive units, dryers, etc., and the space that is required to house the machinery.

Coated papers and paperboards that have received a coating that contains an additive designed to impart functional properties, such as barrier properties, printability properties, adhesive properties, release properties, and optical properties such as color, brightness, opacity, gloss, etc., are described as functional products and their coatings may be referred to as functional coatings. The coating components that impart these properties may also be referred to as functional additives. Functional products include paper types such as self adhesive papers, stamp papers, wallpapers, silicone release papers, food packaging, grease-proof papers, moisture resistant papers, and saturated tape backing papers.

The curtain coating method for the simultaneous coating of multiple layers is well known and is described in U.S. Pat. Nos. 3,508,947 and 3,632,374 for applying photographic compositions to paper and plastic web. However, photographic solutions or emulsions have a low viscosity and a low solids content, and are applied at low coating speeds.

In addition to photographic applications, the simultaneous application of multiple coatings by curtain coating methods is known from the art of making pressure sensitive copying paper. For example, U.S. Pat. No. 4,230,743 discloses in one embodiment the simultaneous application of a base coating comprising microcapsules as a main component and a second layer comprising a color developer as a main component onto a travelling web. However, it is reported that the resulting paper has the same characteristics as the paper made by sequential application of the layers. Moreover, the coating composition containing the color developer is described as having a viscosity between 10 and 20 cps at 22° C.

JP-A-10-328613 discloses the simultaneous application of two coating layers onto a paper web by curtain coating to make an inkjet paper. The coating compositions applied according to the teaching of that reference are aqueous solutions with an extremely low solids content of about 8% by weight. Furthermore a thickener is added in order to obtain non-Newtonian behavior of the coating solutions. The examples in JP-A-10-328613 reveal that acceptable coating quality is only achieved at line speeds below 400 m/min. The low operation speed of the coating process is not suitable for an economic production of printing paper, especially commodity printing paper.

The aforementioned documents do not disclose that a coating composition having a high viscosity under conditions of high shear can be applied to a substrate using curtain coating technology. Nor do the aforementioned documents disclose that a coating composition having shear-thickening behavior can be applied to a substrate using curtain coating technology.

The technical problem underlying the present invention is the provision of a method of producing a coated paper or paperboard, whereby a coating composition having a high viscosity under conditions of high shear is applied to said paper or paperboard.

SUMMARY OF THE INVENTION

The technical problem is solved by a method of producing a coated paper or paperboard, but excluding photographic papers, comprising the steps of: (a) forming a free flowing curtain comprising at least one layer, whereby the composition forming at least one layer of the free flowing curtain has, at a shear rate of 500,000 $s^{-1}$, a high shear viscosity of at least about 50 mPa·s as measured using the Capillary High-shear Viscosity Test described hereinbelow, and (b) contacting the curtain with a continuous web substrate of basepaper and paperboard.

In another embodiment of the present invention the problem of the invention is solved by a method of producing a coated paper or paperboard comprising the steps of: (a) forming a free flowing curtain comprising at least one layer, whereby a composition forming at least one layer of the free flowing curtain has, at a temperature of 25° C., a Shear-Thickening Index of at least about 1.2 and (b) contacting the curtain with a continuous web substrate of basepaper and paperboard.

In another embodiment of the present invention the problem of the invention is solved by a method of producing a coated paper or paperboard comprising the steps of: (a) forming a free flowing curtain comprising at least one layer, whereby a composition forming at least one layer of the free flowing curtain exhibits, at a temperature of 25° C., a Shear-Blocking Behavior and (b) contacting the curtain with a continuous web substrate of basepaper and paperboard. The presence of Shear-Blocking Behavior is determined by observing an increase in viscosity of greater than about 100% in less than a factor of 10 increase in shear rate, where the viscosity values are measured using the Parallel Plate Viscosity Test as specified hereinbelow.

In another embodiment of the present invention the problem of the invention is solved by a method of producing a coated paper or paperboard comprising the steps of: (a) forming a free flowing curtain comprising at least one layer, whereby a composition forming at least one layer of the free flowing curtain exhibits a difference between the Immobilization Solids Content and the Coating Application Solids of less than about 17, and (b) contacting the curtain with a continuous web substrate of basepaper and paperboard.

In another embodiment of the present invention the problem of the invention is solved by a method of producing a coated paper or paperboard comprising the steps of: (a) forming a free flowing curtain comprising at least one layer, whereby the pigment of a composition forming at least one layer of the free flowing curtain has a particle size of at least about 2 microns, and (b) contacting the curtain with a continuous web substrate of basepaper and paperboard.

DETAILED DESCRIPTION OF THE INVENTION

The Shear-Thickening Index is determined by the ratio of the viscosity at 30,000 $s^{-1}$ to the viscosity at 3000 $s^{-1}$. The viscosity values are measured using the Parallel Plate Viscosity Test as specified hereinbelow. If the viscosity at 30,000 $s^{-1}$ is greater than the viscosity at 3,000 $s^{-1}$, then the Shear-Thickening Index will have a value greater than one indicating shear-thickening behavior.

Unexpectedly, it is possible to successfully apply the curtain of step a) to a substrate when at least one layer comprises a composition having a Shear-Thickening Index of at least about 1.2. Preferably, the Shear-Thickening Index is at least about 1.3, more preferably at least about 1.4 and most preferably at least about 1.5.

In a preferred embodiment, the free flowing curtain of step (a) is a multilayer free flowing curtain. The free flowing curtain can preferably be applied according to the present invention by using a curtain coating unit with a slide nozzle arrangement for delivering multiple liquid layers to form a continuous, multilayer curtain. Alternatively, an extrusion type supplying head, such as a slot die or nozzle having several adjacent extrusion nozzles, can be employed in the practice of the present invention.

It is preferred that at least one layer of the free flowing curtain of step (a) has, at a temperature of 25° C. and at a shear rate of 500,000 $s^{-1}$, a high-shear viscosity of at least about 75 mPa·s, preferably at least about 100 mPa·s, and most preferably at least about 125 mPa·s.

In a preferred embodiment, the coated paper or paperboard is not a pressure sensitive copying paper. As used herein, the term "paper" also encompasses paperboard, unless such a construction is clearly not intended as will be clear from the context in which this term is used. The term "excluding photographic papers" should be interpreted in the sense that none of the layers of the curtain used in the practice of the present invention comprise silver compounds. The term "excluding pressure sensitive copying paper" should be interpreted in the sense that the layers of the curtain used in the practice of the present invention do not contain a combination of a microencapsulated color former and a color developer in a single layer or in different layers.

The multilayer free flowing curtain of the invention has a bottom or interface layer, a top layer and optionally one or more internal layers. The free falling curtain may include further layers in addition to the at least one layer having the specific rheological properties according to the teaching of the present. Conventional coating formulations, referred to in the industry as coating colors, can be employed in the curtain. Each layer can comprise a liquid, emulsion, suspension, dispersion, solution, or combination thereof. The coating curtain of the present invention includes at least one, desirably at least two, at least three, at least four, at least five, or at least six layers or more. The layers of the curtain can include one or more coating layers, one or more functional layers, and/or one or more printing layers.

At least one layer of the free flowing curtain of the invention preferably comprises at least one pigment. Examples of suitable pigments include clay, kaolin, calcined clay, co-structured pigments, talc, calcium carbonate, titanium dioxide, satin white, synthetic polymer pigments, zinc oxide, barium sulfate, gypsum, silica, synthetic magadiite, alumina trihydrate, mica, and diatomaceous earth. The pigment can be naturally occurring, synthetic, or engineered. When used in coating compositions, such pigments contribute to improved paper properties such as better opacity, improved gloss and/or better printing properties. Mixtures of pigments can be employed. The pigment can have any of various shapes known in the art, including blocky, dendritic, platy, acicular, globular, and the like. One advantage of the present invention is the surprising ability to employ any shape of pigment, including acicular pigments, which are difficult to employ with a blade coating process.

Unexpectedly, engineered pigments, when formulated in a coating composition having at a shear rate of 500,000 $s^{-1}$ a high shear viscosity of at least about 50 mPa·s can readily be applied to substrates using the method of the present invention.

The morphology and structure of some pigments, such as co-structured pigments, is destroyed at a high shear rate and, thus, the properties of such pigments are detrimentally affected in conventional paper coating processes, such as the blade coating system. Unexpectedly, with the method of the present invention it is possible to apply to a substrate a composition comprising at least one pigment, the morphology and structure of which is destroyed at a shear rate of less than 500,000 $s^{-1}$, as a component of at least one layer of the free flowing curtain. In a preferred embodiment, the shear rate at which the morphology and structure of said pigments are detrimentally affected is less than about 100,000 $s^{-1}$, more preferably about 50,000 $s^{-1}$ and most preferably at least about 10,000 $s^{-1}$.

In a further embodiment, at least one layer of the free flowing curtain of step (a) comprises at least one pigment having an aspect ratio of at least about 1.5:1. Preferably, such pigments have an aspect ratio that is at least about 5:1, more preferably at least about 10:1, even more preferably at least about 15:1, and most preferably at least about 20:1. In a further preferred embodiment, the aspect ratio of said pigment is at least about 30:1, more preferably at least about 40:1 and most preferably at least about 60:1.

Preferably, at least one layer of the free flowing curtain of the invention comprises a binder. The binder can be any binder customary to a person skilled in the art. Examples of binders include styrene-butadiene latex, styrene-acrylate latex, styrene-butadiene-acrylonitrile latex, styrene-acylate-acrylonitrile latex, styrene-butadiene-acrylate-acrylonitrile latex, styrene-maleic anhydride latex, styrene-acrylate-maleic anhydride latex, polysaccharides, proteins, polyvinyl pyrrolidone, polyvinyl alcohol, polyvinyl acetate, and cellulose derivatives. A wide variety of binders are commercially available. Mixtures of binders can be employed.

The curtain of the invention can include one or more functional layers. The purpose of a functional layer is to impart a desired functionality to the coated paper. Functional layers can be selected to provide, for example, printability, barrier properties, such as moisture barrier, aroma barrier, water and/or water vapor barrier, solvent barrier, oil barrier, grease barrier and oxygen barrier properties, sheet stiffness, fold crack resistance, paper sizing properties, release properties, adhesive properties, and optical properties, such as, color, brightness, opacity, gloss, etc. Functional coatings that are very tacky in character would not normally be coated by conventional consecutive coating processes because of the tendency of the tacky coating material to adhere the substrate to guiding rolls or other coating equipment. The simultaneous multilayer method, on the other hand, allows such functional coatings to be placed underneath a topcoat that shields the functional coating from contact with coating machinery.

The solids content of a functional layer can vary widely depending on the desired function. A functional layer of the present invention preferably has a solids content of up to about 75% by weight based on the total weight of the functional layer, and a viscosity of up to about 3,000 cps (Brookfield, spindle 5, 100 rpm, 25° C.), more preferably about 50 to about 2,000 cps. Preferably, the coatweight of a functional layer is from about 0.1 to about 10 $g/m^2$, more preferably about 0.5 to about 3 $g/m^2$. In certain situations, such as, for example, when a dye layer is employed, the coatweight of the functional layer can be less than about 0.1 $g/m^2$.

The functional layer of the present invention can contain one or more materials such as, for example: a polymer of ethylene acrylic acid; a polyethylene; other polyolefins; a polyurethane; an epoxy resin; a polyester; an adhesive such as a styrene butadiene latex, a styrene acrylate latex, a carboxylated latex, a starch, a protein, or the like; a sizing agent such as a starch, a styrene-acrylic copolymer, a styrene-maleic anhydride, a polyvinyl alcohol, a polyvinyl acetate, a carboxymethyl cellulose or the like; a barrier such as ethylene vinyl alcohol, silicone, or a wax or the like. The functional layer can include, but is not limited to include, a pigment or binder as previously described for each coating layer.

For the purposes of the present invention, in a multilayer curtain the layer most distant from the substrate paper is referred to as the top layer. In a preferred embodiment, the free flowing curtain of step (a) comprises a top layer ensuring printability since this layer typically is the layer that will be printed upon. It is possible that the coated paper of the present invention could also be further coated using conventional means, such as rod, blade, roll, bar, or air knife coating techniques, and the like. The top layer can be a coating layer or a functional layer, including a gloss layer. In a preferred embodiment of the invention, the top layer is very thin, having a coatweight of, for example from about 0.5 to about 3 $g/m^2$. This advantageously allows the use of less expensive materials under the top layer, while still producing a paper having good printing properties. In one embodiment, the top layer is free of mineral pigment.

According to a particularly preferred embodiment, the top layer comprises a glossing formulation. The novel combination of glossing formulation and simultaneous multilayer curtain coating combines the advantages of curtain coating with good gloss.

The glossing formulations useful in the present invention comprise gloss additives, such as synthetic polymer pigments, including hollow polymer pigments, produced by polymerization of, for example, styrene, acrylonitrile and/or acrylic monomers. The synthetic polymer pigments suitably have a glass transition temperature of about 40 to about 200° C., more preferably about 50 to about 130° C., and a particle size of about 0.02 to about 10 μm, more preferably about 0.05 to about 2 μm. The glossing formulations contain about 5 to about 100 wt. %, based on solids, of gloss additive, more preferably about 60 to about 100 wt. %. Another type of glossing formulation comprises gloss varnishes, such as those based on epoxyacrylates, polyester, polyesteracrylates, polyurethanes, polyetheracrylates, oleoresins, nitrocellulose, polyamide, vinyl copolymers and various forms of polyacrylates.

When the curtain has at least 3 layers, then it has at least one internal layer. The viscosity of the internal layer(s) is not critical, provided a stable curtain can be maintained. When more than one internal layer is present, combinations of functional and coating layers can be employed. For example, the internal layers can comprise a combination of identical or different functional layers, a combination of identical or different coating layers, or a combination of coating and functional layers.

The interface layer is the layer that comes in contact with the substrate to be coated. One important function of the interface layer is to promote wetting of the substrate. The interface layer can have more than one function. For example, in addition to wetting, it may provide coverage of the substrate, and improved functional performance such as adhesion, sizing, stiffness or a combination of functions. In the case of a multilayer curtain of the invention, the interface layer is preferably a relatively thin layer. The coatweight of the interface layer suitably is from about 0.1 to about 5 $g/m^2$, preferably from about 1 to about 3 $g/m^2$. The solids content of the interface layer suitably is from about 0.1 to about 65%, based on the weight of the interface layer in the curtain. In one embodiment, the interface layer is relatively low in solids, preferably having a solids content of from about 0.1 to about 40%.

The solids content of the curtain of step a) can range from about 10 to about 80 wt. %, preferably about 20 to about 75 wt. %, based on the total weight of the curtain. Furthermore, it is preferred that the free flowing curtain of step (a) has a solids content of at least about 30 wt. %, preferably of at least about 40 wt. %, more preferably of at least about 50 wt. %, even more preferably at least about 55 wt. %, and most preferably of at least about 60 wt. %.

According to a preferred embodiment, the solids content of at least one of the layers forming the composite free falling curtain is higher than about 60 wt. % based on the total weight of the coating layer. In a further embodiment of the present invention, at least one layer of the free flowing curtain of step (a) has a solids content of at least about 30 wt. %, preferably of at least about 40 wt. %, and most preferably of at least about 50 wt. %. In one embodiment, one or more layers of the curtain can have a solids content of 0 wt. %.

Contrary to the art of photographic papers or pressure sensitive copying papers, the method of the present invention can be practiced with curtain layers having a viscosity in a wide range and a high solids content even at high coating speeds.

The process of the present invention advantageously makes it possible to vary the composition and relative thickness of the layers in a multilayer composite structure. The composition of the multiple layers can be identical or different depending on the grade of paper being produced. For example, a thin layer next to the basepaper designed for adhesion, with a thick internal layer designed to provide sheet bulk, and a very thin top layer designed for optimum printing can be combined in a multilayer curtain to provide a composite structure. In another embodiment, an internal layer designed specifically for enhanced hiding can be employed. Other embodiments of variable coatweight layers in a multilayer composite include a thin layer of less than about 2 g/m$^2$ as at least one of the top, internal or bottom layers of the composite coating. Using the process of the invention, the substrate paper can be coated on one or both sides.

In a preferred embodiment at least one layer of the free-flowing curtain of step a) suitably can comprise additives customary to a person skilled in the art, such as, for example, at least one surfactant, at least one dispersant, at least one lubricant, at least one water-retention agent, at least one crosslinking agent, at least one optical whitening agent, at least one pigment, dye or colorant, at least one thickening agent, at least one defoamer, at least one antifoaming agent, at least one biocide and/or at least one soluble dye or colorant, or the like. Polyethylene oxide is an example of a preferred additive, and can be employed in any layer. In a preferred embodiment, polyethylene oxide is employed as a thickening agent, preferably at least in the interface layer. Advantageously, the polyethylene oxide has a weight average molecular weight of at least about 50,000, preferably at least about 100,000, more preferably at least about 500,000, and most preferably at least about 800,000. Preferably, the amount of polyethylene oxide employed is sufficient to prevent cratering, and is preferably less than about 2 wt. %, based on the weight of solids in the layer in which it is employed.

In a further embodiment, at least one layer of the free flowing curtain of step (a) has a dry coatweight of less than about 10 g/m$^2$, preferably of less than about 8 g/m$^2$, most preferably of less than about 6 g/m$^2$.

In one embodiment of the invention, the continuous web substrate of step (b) is neither precoated nor precalendared. In another embodiment, the web substrate is not precoated. In a further embodiment, the web substrate is not precalendared. Preferably, the continuous web substrate of step (b) has a web velocity of at least about 300 m/min, even more preferably of at least about 400 m/min, and most preferably of at least about 500 m/min. In a further embodiment the continuous web substrate has a velocity of at least about 800 m/min and preferably of at least about 1000 m/min. The continuous web substrate suitably has a grammage, or basis weight, of from about 20 to 350 g/m$^2$.

SPECIFIC EMBODIMENTS OF THE INVENTION

Figure 1:
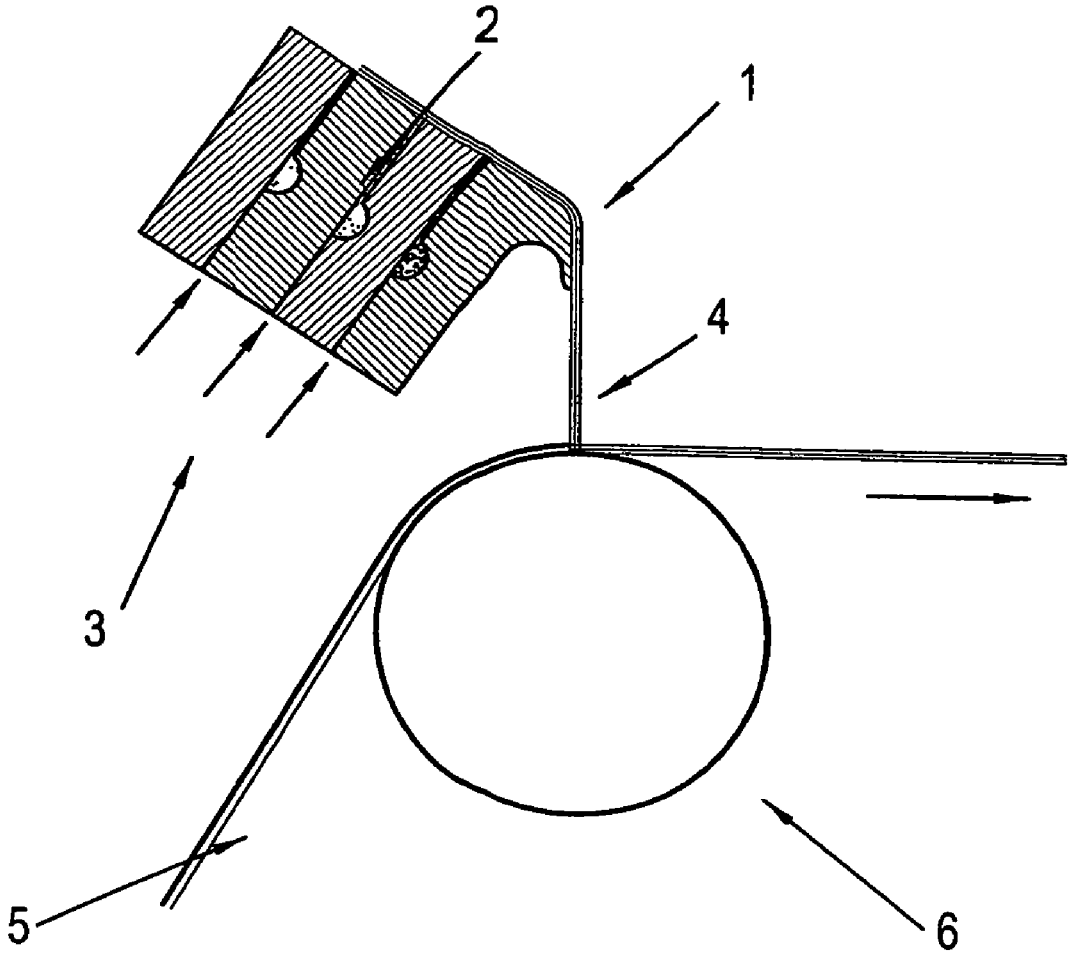
FIG. 1 is an explanatory cross-sectional view of a preferred curtain coating unit 1 with a slide nozzle arrangement 2 for delivering multiple streams 3 of curtain layer to form a continuous, multilayer curtain 4. When a dynamic equilibrium state is reached, the flow amount of the curtain layers flowing into the slide nozzle arrangement 2 is completely balanced with the flow amount flowing out of the slide nozzle arrangement. The free falling multilayer curtain 4 comes into contact with web 5, which is running continuously, and thus the web 5 is coated with the multilayer curtain. The running direction of the web 5 is changed immediately before the coating area by means of a roller 6 to minimize the effect of air flow accompanying the fast moving web 5.

The present invention is illustrated by the following examples. All parts and percentages are by weight unless otherwise indicated.

Formulations

The following materials were used in the coating liquids:

Carbonate (A): dispersion of calcium carbonate with particle size of 90%<2 μm in water (HYDROCARB 90 ME available from Pluess-Stauffer), 77% solids.

Carbonate (B): dispersion of calcium carbonate with particle size of 60%<2 μm in water (HYDROCARB 60 ME available from Pluess-Stauffer), 77% solids.

Carbonate (C): dispersion in water of engineered calcium carbonate with narrowed particle size distribution and a particle size of 75%<2 μm (COVERCARB 75 available from Pluess-Stauffer), 72% solids.

Carbonate (D): calcium carbonate with a particle size of 36%<2 μm (MILLICARB OG available from Pluess-Stauffer), available as a powder.

Clay (A): dispersion of calcined clay in water (ANSILEX 93, fine particle calcined kaolin, with particle size distribution of 86-90% below 2 microns, average particle size=0.8 micron, 50% solids, available from Engelhard Corporation, Iselin N.J.).

Clay (B): dispersion of high aspect ratio clay in water (KSZ 81 available from AKW—Kick, Hirschau Germany), 59.8% solids, aspect ratio 55-60:1.

Clay (C): dispersion of No. 1 high brightness kaolin clay with particle size of 98%<2 μm in water (HYDRAGLOSS 90 available from J.M Huber Corp., Have de Grace, Maryland, USA), 71% solids.

Latex: carboxylated styrene-butadiene latex (DL 966 available from The Dow Chemical Company), 50% solids in water.

PVOH: solution of 15% of low molecular weight synthetic polyvinyl alcohol (MOWIOL 6/98 available from Clariant AG, Basel, Switzerland).

Thickener (A): anionic water-in-oil emulsion of an acrylamide-acrylic acid copolymer (STEROCOL BL available from BASF, Ludwigshafen, Germany), 37% solids.

Thickener (B): a 900,000 molecular weight non-ionic high molecular weight water-soluble poly(ethylene oxide) polymer (POLYOX WSR-1105 available from The Dow Chemical Company), prepared as a 4% solids solution.

Surfactant: aqueous solution of sodium di-alkylsulphosuccinate (AEROSOL OT available from Cyanamid, Wayne, N.J., USA), 75% solids.

Whitener: fluorescent whitening agent derived from diamino-stilbenedisulfonic acid (TINOPAL ABP/Z, available from Ciba Specialty Chemicals Inc., Basel, Switzerland).

The pH of the pigmented coatings formulations was adjusted to by adding NaOH solution (10%). Water was added as needed to adjust the solids content of the formulations.

Coating Procedure

The formulations detailed below were coated onto paper according to the following procedure. A multilayer slide die type curtain coater manufactured by Troller Schweizer Engineering (TSE, Murgenthal, Switzerland) was used. The curtain coating apparatus was equipped with edge guides lubricated with a trickle of water and with a vacuum suction device to remove this edge lubrication water at the bottom of the edge guide just above the coated paper edge. In addition, the curtain coater was equipped with a vacuum suction device to remove interface surface air from the paper substrate upstream from the curtain impingement zone. The height of the curtain was 300 mm. Coating formulations were deaerated prior to use to remove air bubbles. The coatweight achieved in each coating experiment was calculated from the known volumetric flow rate of the pump delivering the coating to the curtain coating head, the speed at which the continuous web of paper was moving under the curtain coating head, the density and percent solids of the curtain, and the width of the curtain.

The comparative blade coating experiments were carried out using a conventional blade coater. The blade pressure is controlled by adjusting the head angle up to a maximum of 24 degrees.

Test Methods

Brookfield Viscosity

The viscosity is measured using a Brookfield RVT viscometer (available from Brookfield Engineering Laboratories, Inc., Stoughton, Mass., USA). For viscosity determination, 600 ml of a sample are poured into a 1000 ml beaker and the viscosity is measured at 25° C. at a spindle speed of 100 rpm.

Parallel Plate Viscosity Test

The viscosity is measured using a Physica UDS 200 Viscometer (available from Paar Physica). The sample is tested at 25° C. using a 50 mm diameter parallel plate geometry with a measurement gap of 0.03 mm. The shear rate is ramped from 10 $s^{-1}$ to 100,000 $s^{-1}$ over a period of 2 minutes using logarithmic steps in shear rate with 10 steps/decade of shear rate. The viscosity at 3000 $s^{-1}$ and 30,000 $s^{-1}$ is determined by interpolation of the measured values. The Shear-Thickening Index is calculated by dividing the viscosity value at 30,000 $s^{-1}$ by the viscosity value at 3000 $s^{-1}$. A Shear-Thickening Index value greater than one is indicative of shear-thickening behavior. If the viscosity versus shear rate flow curve exhibits a sudden sharp increase in viscosity (greater than 100% viscosity increase in less than a factor of 10 increase in shear rate), then the coating is deemed to have Shear-Blocking Behavior.

Capillary High-Shear Viscosity Test

The high shear viscosity is measured using an ACAV II Capillary Viscometer (available from ACA Systems in Finland). Approximately 1000 cc of sample is placed in the measuring cylinder and the measurement temperature is 25° C. A glass capillary having a diameter of 0.5 mm and a length of 50 mm is used for the measurements. The use of a capillary with a length/diameter ratio of 100 minimizes the impact of end effects on the measurement. The sample viscosity is measured from 100,000 $s^{-1}$ to 1,500,000 $s^{-1}$ using 12 logarithmic steps in shear rate. If the maximum testing pressure (300 bar) is reached before the 1,500,000 $s^{-1}$ shear rate, then the test is terminated. The viscosity is calculated from the measured pressure versus flow rate curve. The ACAV II software corrects the data for kinetic energy. The viscosity at 500,000 $s^{-1}$ is then determined by interpolation of the experimental data.

Water Retention

Water retention-of a coating color is measured with an AA-GWR gravimetric water retention meter (available from OY Gradek Ab, Kauinianen, Finland). The test cell is placed on top of a non-hydroscopic polycarbonate filter with 0.8 micron pore size (Nucleopore brand, available from Sterico AG, Dietikon, Switzerland) that is placed on top of a preweighed absorbing paper (Whatman Chromatographic paper 17 CHR, available from VMR International AG, Dietikon, Switzerland). The assembly is placed onto the backing table and tightened. Then, 10 ml of coating color is poured in the test cell, which is immediately closed with the plug. The timer is started. After 15 seconds, the cell is pressurized at 1 bar. Upon completion of 90 seconds, the pressure is removed and the plug cell removed. After an additional 15 seconds, the absorbing paper is separated from the filter membrane. The amount of absorbed liquid is determined by weighing the absorbing paper with a balance accurate to 0.0001 g. The amount of absorbed liquid per square meter is calculated using an average of 3 measurements.

Immobilization Solids Content

A Coesfeld Minimum Film Forming Temperature device (available from Coesfeld, Dortmund, Germany) is used. Over a 50 cm long glass plate put on a metal plate, a temperature gradient is reached by heating one end to 50° C. and keeping the other end at 10° C. A coating color layer 14 cm wide and 0.4 mm wet thickness is put over the plate using a drawdown bar. The solids of the coating color is measured prior to application to the plate and is defined as the Coating Application Solids for the purposes of this invention. A drying front progresses from the hot end toward the cold one. After about 15 minutes, samples of coating color are taken at the drying front with a spatula. The solids content of the samples are measured. An average of 6 measurements is taken as the Immobilization Solids Content.

Coatweight

The coatweight achieved in each paper coating experiment is calculated from the known volumetric flow rate of the pump delivering the coating to the curtain coating head, the speed at which the continuous web of paper is moving under the curtain coating head, the density and percent solids of the curtain, and the width of the curtain.

Degree of Cratering

The degree of cratering is determined by visual observation of burn out samples. A (50/50) water/isopropyl alcohol solution with 10% $NH_4Cl$ is used. Paper coated on only one side is immersed for 30 sec in the solution; paper coated on both sides is immersed for 60 sec. After removing the excess of solution with a blotting paper the samples are air dried overnight. Burn out is done in an oven at 225° C. for 3.5 min. Craters are counted within a 3×3 cm section of the burn out samples with the help of magnifying glasses (magnification ×10). Very small uncoated spots with perfect circular shape are not taken as craters; they are assumed to be pitting given by micro bubbles in the coating from air entrainment. Also not taken in account are elliptical uncoated areas oriented with the long axis in the machine direction (the direction in which the paper is moving) given by larger bubbles present in the coating formulation that are not removed by deaeration.

Coating Density

The density of a curtain layer is determined by weighing a 100 ml sample of the coating in a pyknometer.

Paper Roughness

The roughness of the coated paper surface is measured with a Parker PrintSurf roughness tester. A sample sheet of coated paper is clamped between a cork-melinex platen and a measuring head at a clamping pressure of 1,000 kPa. Compressed air is supplied to the instrument at 400 kPa and the leakage of air between the measuring head and the coated paper surface is measured. A higher number indicates a higher degree of roughness of the coated paper surface.

Brightness

Brightness is measured on a Zeiss Elrepho 2000. Brightness is measured according to ISO standard 2469 on a pile of sheets. The result is given as R457.

Opacity

Opacity is measured on a Zeiss Elrepho 2000. Opacity is measured on a single sheet backed by black standard ($R_0$) and on a pile of sheets ($R_\infty$). The result is given as $R_0/R_\infty \times 100\%$.

Particle Size

The median Stokes equivalent spherical particle size and particle size distribution are measured using an X-Ray sedigraph instrument (SediGraph 5100 Particle Size Analysis System available from Micromeritics, Norcross, Ga., USA). Raw material manufacturers supplied particle size and particle size distribution numbers for raw materials employed in the Examples.

Aspect Ratio

The aspect ratio is measured using an electron microscope image analysis method described in "Aspect Ratios of Pigment Particles Determined by Different," *Nordic Pulp and Paper Research Journal,* Vol. 15, No. 3/2000, pp. 221-230.

EXAMPLE 1

The above ingredients are mixed in the amounts given in Table 1 to demonstrate the use of the high aspect ratio clay.

TABLE 1

| | Slot 1 | Slot 2 |
|---|---|---|
| Carbonate (A) | 100 | |
| Clay (B) | | 100 |
| Latex | 13 | 13 |
| PVOH | 1 | 3.5 |
| Surfactant | 0.4 | 0.2 |
| Whitener | | 1 |
| pH | 8.5 | 8.6 |
| Solids (%) | 60.1 | 55.7 |
| Density (g/cm$^3$) | 1.51 | 1.43 |
| Brookfield Viscosity [mPa · s] | 120 | 755 |
| Viscosity at 3,000 s$^{-1}$ [mPa · s] | 29.9 | 114 |
| Viscosity at 30,000 s$^{-1}$ [mPa · s] | 13.5 | 150 |
| Viscosity at 500,000 s$^{-1}$ [mPa · s] | 13.6 | 57.9 |
| Shear-Thickening Index | 0.45 | 1.32 |

The viscosity at 500,000 s$^{-1}$ for the coating in Slot 2 exceeds the range observed to be problematic for running on blade coaters (greater than 50 mPa·s) and the shear thickening index is greater than 1.2.

The trial speeds and coatweights for each layer for Example 1 are given in Table 2. The basepaper is a wood-containing paper with a surface roughness of 4.3 microns.

TABLE 2

| Speed [m/min] | Slot 1 coatweightg/m$^2$(dry) | Slot 2 coatweightg/m$^2$(dry) |
|---|---|---|
| 1000 | 2 | 6 |
| 1000 | 2 | 8 |
| 1200 | 2 | 8 |
| 1500 | 2 | 8 |

A pigmented layer (slot 1) is placed next to the paper. A second layer is added simultaneously using slot 2. This layer contains the high aspect ratio clay. The multilayer coating is successfully applied at all conditions in Table 2 without runnability problems.

EXAMPLE 2

The above ingredients are mixed in the amounts given in Table 3 to demonstrate the use of the calcined clay.

TABLE 3

| | Slot 1 | Slot 2 |
|---|---|---|
| Carbonate (A) | 100 | |
| Clay | | 100 |
| Latex (A) | 13 | 13 |
| PVOH | 1 | 3.5 |
| Surfactant | 0.4 | 0.2 |
| Whitener | | 1 |
| pH | 8.5 | 8.6 |
| Solids (%) | 60.1 | 47.9 |
| Density (g/m$^2$) | 1.51 | 1.36 |
| Brookfield Viscosity [mPa · s] | 120 | 470 |
| Viscosity at 3,000 s$^{-1}$ [mPa · s] | 29.9 | 30.7 |
| Viscosity at 30,000 s$^{-1}$ [mPa · s] | 13.5 | 47.6 |
| Viscosity at 500,000 s$^{-1}$ [mPa · s] | 13.6 | 105.2 |
| Shear-Thickening Index | 0.45 | 1.55 |

The viscosity at 500,000 s$^{-1}$ for the coating in Slot 2 exceeds the range observed to be very problematic for running on blade coaters (greater than 100 mPa·s) and the shear thickening index is greater than 1.5.

Trial speed and coatweights for each layer of Example 2 are given in Table 4. The basepaper is a wood-containing paper with a surface roughness of 4.3 microns.

TABLE 4

| Speed [m/min] | Slot 1 coatweight g/m$^2$(dry) | Slot 2 coatweight g/m$^2$(dry) |
|---|---|---|
| 1000 | 2 | 6 |
| 1000 | 2 | 8 |
| 1200 | 2 | 6 |
| 1200 | 2 | 8 |

A pigmented layer (slot 1) is placed next to the paper. A second layer is added simultaneously using slot 2, and this layer contains the calcined clay. The multilayer coating is successfully applied at all conditions in Table 4 without runnability problems. The coated paper sample from the first test condition in Table 4 is significantly improved opacity (92.6 versus 90.4) and significantly improved brightness (80.4 versus 73.7) when compared to a single 8 g/m$^2$ laboratory blade-coated sample in which Clay (C) is substituted for Clay (A) in the formulation for Slot 2 given in Table 3.

EXAMPLE 3

The method of Example 1 is repeated using a thickener in place of some of the polyvinyl alcohol (PVOH) in the top layer (Slot 2). The thickener employed in the comparative experiments is chosen for its compatibility for high-speed blade coating as well as for its ability to provide crater-free curtain coating at high coating speeds. In addition, the amount of PVOH in the bottom layer (Slot 1) is increased to 2 parts and the whitener is removed from the top layer (Slot 2). The coating ingredients are mixed in the amounts given in Table 5.

TABLE 5

| | Slot 1 | Slot 2 |
|---|---|---|
| Carbonate (A) | 100 | |
| Clay (B) | | 100 |
| Latex | 13 | 13 |
| PVOH | 2 | 1.0 |
| Thickener (A) | | 0.2 |
| Surfactant | 0.4 | 0.2 |
| pH | 8.5 | 8.6 |
| Solids (%) | 60.3 | 55.8 |
| Density (g/cm$^3$) | 1.51 | 1.43 |
| ABO Water Retention (g/m$^2$) | NM* | 76 |
| Brookfield Viscosity [mPa · s] | 350 | 740 |
| Viscosity at 3,000 s$^{-1}$ [mPa · s] | NM | 153 |
| Viscosity at 30,000 s$^{-1}$ [mPa · s] | NM | 214 |
| Viscosity at 500,000 s$^{-1}$ [mPa · s] | NM | 96 |
| Shear-Thickening Index | NM | 1.39 |

(*NM = Not Measured)

The viscosity at 500,000 s$^{-1}$ for the coating in Slot 2 exceeds the range observed to be difficult for running on blade coaters (greater than 75 mPa·s) and the Shear Thickening Index is greater than 1.2.

The coatweights for each layer are 1.5 g/m$^2$(dry) for Slot 1 and 6.5 g/m$^2$(dry) for Slot 2. The 8 g/m$^2$(dry) total coatweight multilayer coating is applied at 1250 m/min and 1500 m/min. The basepaper is a 35 g/m$^2$ wood-containing paper with a surface roughness of 4.8 microns. The coating applied at 1250 m/min gives a crater-free coating, while the coating applied at 1500 m/min gives an almost crater free coating with no other runnability problems. This demonstrates that coatings with high aspect ratio pigments and high high-shear viscosity can be easily applied with a curtain coater at high coating speeds using the process of the invention.

Comparative Experiment A

An attempt is made to apply the coating with the high aspect ratio pigment (Slot 2 of Example 3) onto the same basepaper as Example 3 using a jet applicator blade coater. With the jet applicator it is impossible to properly apply the coating at 1250 m/min, as the coating is deflected from the paper web when it hit the web.

Comparative Experiment B

The method of Comparative Example A is repeated except that the coating mixture shown in Table 6 is used. This coating composition represents the blend of the pigment compositions for the two coatings (Slots 1 and 2) used in Example 3. The PVOH, surfactant, and thickener levels are kept the same as for the top layer (Slot 2) in Example 3.

TABLE 6

| | |
|---|---|
| Carbonate (A) | 19 |
| Clay (B) | 81 |
| Latex | 13 |

TABLE 6-continued

| | |
|---|---|
| PVOH | 1.0 |
| Thickener (A) | 0.2 |
| Surfactant | 0.2 |
| pH | 8.6 |
| Solids (%) | 59.2 |
| Density (g/cm$^3$) | 1.46 |
| ABO Water Retention (g/m$^2$) | 74 |
| Brookfield Viscosity [mPa · s] | 1690 |
| Viscosity at 3,000 s$^{-1}$ [mPa · s] | 215 |
| Viscosity at 30,000 s$^{-1}$ [mPa · s] | 294 |
| Viscosity at 500,000 s$^{-1}$ [mPa · s] | 110 |
| Shear-Thickening Index | 1.37 |

A coating of 8.3 g/m$^2$(dry) total coatweight is applied at 1250 m/min using the jet applicator blade coater onto the same basepaper used in Example 3. The metering blade is a 0.4-mm thick blade with a 45-degree bevel operating with a blade load (head angle) of 12.1 degrees. The blade exhibits an extreme amount of wet bleeding (about 30 g of coating bleeds for 2 minutes of running time). In addition, the paper has numerous areas of skip coating, i.e. uncoated areas. When the blade bevel is changed to 40 degrees, then the blade runs clean but the blade load is very high (at the maximum head angle of 24 degrees the coatweight was 8.3 g/m$^2$). These blade conditions would lead to frequent web breaks and rapid blade wear, thus causing unacceptably high levels of downtime in a production facility.

At 1500 m/min using the 0.4-mm thick blade with a 45-degree bevel the runnability problems are even more severe. The blade pressure (head angle) needed to reach 8.0 g/m$^2$(dry) total coatweight is 22.7 degrees. There is very pronounced bleeding (37.5 g of coating bleeding out after 2 minute run) and the degree of skip coating is unacceptable.

EXAMPLE 4

The method of Example 2 is repeated using a thickener in place of some of the polyvinyl alcohol (PVOH) in the top layer (Slot 2). The thickener is chosen for its compatibility for high-speed blade coating in the comparative experiments as well as for its ability to provide crater-free curtain coating at high coating speeds. In addition, the amount of PVOH in the bottom layer (Slot 1) is increased to 2 parts and the whitener is removed from the top layer (Slot 2). The coating ingredients are mixed in the amounts given in Table 7.

TABLE 7

| | Slot 1 | Slot 2 |
|---|---|---|
| Carbonate (A) | 100 | |
| Clay (A) | | 100 |
| Latex | 13 | 13 |
| PVOH | 2 | 2.0 |
| Thickener (A) | | 0.2 |
| Surfactant | 0.4 | 0.2 |
| pH | 8.5 | 8.6 |
| Solids (%) | 60.3 | 48.8 |
| Density (g/cm$^3$) | 1.51 | 1.38 |
| Brookfield Viscosity [mPa · s] | 350 | 410 |
| Viscosity at 3,000 s$^{-1}$ [mPa · s] | NM* | 595 |
| Viscosity at 30,000 s$^{-1}$ [mPa · s] | NM | Too high to measure |
| Viscosity at 500,000 s$^{-1}$ [mPa · s] | NM | 137 |
| Shear-Thickening Index | NM | not calculable |
| Shear Blocking Behavior | NM | Yes |

(*NM = Not Measured)

The viscosity at 500,000 s$^{-1}$ for the coating in Slot 2 exceeds the range observed to be very difficult for running on blade coaters (greater than 100 mPa·s) and in addition the coating exhibits Shear Blocking Behavior.

The coating speed is 1500 m/min and coatweights for each layer were 1.5 g/m$^2$(dry) for Slot 1 and 6.5 g/m$^2$(dry) for Slot 2. The basepaper is a 35 g/m$^2$ wood-containing paper with a surface roughness of 4.8 microns. The multilayer coating with 8 g/m$^2$(dry) total coatweight is applied at 1500 m/min and gives a nearly crater-free coating with no other runnability issues. This demonstrates that coatings with Shear-Blocking Behavior can be easily applied using a curtain coater.

Comparative Experiment C

The coating with the calcined clay pigment (Slot 2 of Example 4) is applied onto the same basepaper as Example 4 using a jet applicator blade coater equipped with a 0.4-mm thick 45 degree angle blade operating. At 1500 m/min the blade load (head angle) needed to achieve 8.4 g/m$^2$(dry) is 21.4 degrees and the blade runs clean. This demonstrates that this calcined clay pigment requires relatively high blade loads.

Comparative Experiment D

The method of Comparative Example C is repeated except that the coating mixture shown in Table 8 is used. This coating composition represents the blend of the pigment compositions for the two coatings (Slots 1 and 2) used in Example 4. The PVOH, surfactant, and thickener levels are kept the same as for the top layer in Example 4. At 1500 m/min the blade load (head angle) needed to achieve 8.0 g/m$^2$(dry) is 22.4 degrees and the blade runs clean.

TABLE 8

| | |
|---|---|
| Carbonate (A) | 19 |
| Clay (A) | 81 |
| Latex | 13 |
| PVOH | 2.0 |
| Thickener (A) | 0.2 |
| Surfactant | 0.2 |
| pH | 8.6 |
| Solids (%) | 51.7 |
| Density (g/cm$^3$) | 1.41 |
| Brookfield Viscosity [Units] | 420 |
| Viscosity at 3,000 s$^{-1}$ [mPa · s] | 523 |
| Viscosity at 30,000 s$^{-1}$ [mPa · s] | Too high to measure |
| Viscosity at 500,000 s$^{-1}$ [mPa · s] | 124 |
| Shear-Thickening Index | Not calculable |
| Shear Blocking Behavior | Yes |

EXAMPLE 5

The procedure of Example 1 is repeated except that the formulations of Table 9 are employed. This example demonstrates the use of an engineered calcium carbonate pigment with a narrow particle size distribution compared to conventional ground calcium carbonate. The coating formulation is prepared at high solids with low thickener content that gives a coating with low water retention and low immobilization solids.

TABLE 9

| | Slot 1 | Slot 2 |
|---|---|---|
| Carbonate (A) | 100 | |
| Carbonate (C) | | 100 |
| Latex | 13 | 11 |
| PVOH | 1.0 | 0.5 |
| Thickener (A) | | 0.17 |

TABLE 9-continued

| | Slot 1 | Slot 2 |
|---|---|---|
| Surfactant | 0.4 | 0.2 |
| pH | 8.5 | 8.6 |
| Solids (%) | 60.0 | 67.2 |
| Density (g/cm$^3$) | 1.51 | 1.38 |
| Water Retention (g/m$^2$) | NM* | 133 |
| Immobilization Solids (%) | NM | 82.3 |
| Brookfield Viscosity [mPa · s] | 240 | 1160 |
| Viscosity at 3,000 s$^{-1}$ [mPa · s] | NM | 162 |
| Viscosity at 30,000 s$^{-1}$ [mPa · s] | NM | 141 |
| Viscosity at 500,000 s$^{-1}$ [mPa · s] | NM | 127 |
| Shear-Thickening Index | NM | 0.87 |

(*NM = Not Measured)

The viscosity at 500,000 s$^{-1}$ for the coating color in Slot 2 exceeds the range observed to be very difficult for running on blade coaters (greater than 100 mPa·s).

The coatweights for each layer are 1.5 g/m$^2$(dry) for Slot 1 and 6.5 g/m$^2$(dry) for Slot 2. The multilayer coating with total 8 g/m$^2$(dry) coatweight is applied at a speed of 1250 m/min onto a 35 g/m$^2$ wood-containing paper with a surface roughness of 4.8 microns. The coating is crater free and is applied with no other runnability problems. This demonstrates the ease of using curtain coating to apply coatings that have a-high rate of dewatering and quick immobilization of the coating.

EXAMPLE 6

The method of Example 5 is repeated except that the coating for Slot 1 is replaced with the same coating used in Slot 2 diluted down to 58.3% solids. This results in a multilayer curtain having the same overall composition differing only in the solids content between the two layers. The applied coating shows no cratering or other runnability defects.

Comparative Experiment E

An attempt is made to apply the coating with the engineered carbonate coating (Slot 2 of Example 5) onto the same basepaper as Example 5 using a jet applicator blade coater. At the maximum blade pressure (head angle) of 24 degrees the coatweight is 11 g/m$^2$(dry). The coating is diluted to 65.5% solids and is a Brookfield viscosity of 890 mPa·s, a viscosity at 500,000 s$^{-1}$ of 107 mPa·s and a water retention value of 137. The coatweight at the maximum blade pressure (head angle=24 degrees) is 9.3 g/m$^2$(dry). The coating is further diluted to 64.3% solids and has a Brookfield viscosity of 730 mPa·s, a viscosity at 500,000 s$^{-1}$ of 88 mPa·s and a Water Retention value of 146. A coatweight of 8.3 g/m$^2$(dry) could be reached for this coating, but there is no stable value for the blade pressure. The blade pressure (head angle) has to be increased continuously up to the maximum value in order to attempt to maintain the coatweight, at which time the coating exceeds the target coatweight of 8 g/m$^2$(dry). In addition, dry coating deposits accumulate on the blade tip (about 3.3 g after 3.75 min. running time). These dry "beards" are quite large and would eventually cause streaks on the coated paper surface. The poor runnability. of this coating is attributed to the rapid rate of dewatering, and to immobilization of the coating under the blade.

EXAMPLE 7

The above ingredients are mixed in the amounts given in Table 10 to demonstrate the use of Carbonate D, a coarse carbonate pigment. This carbonate pigment has 2 wt. % of the particles with a diameter greater than 12 μm. Such a pigment cannot be coated with a blade coater without severe streaking because of the large particles, whose diameters approach that of the wet coating thickness.

TABLE 10

| | Slot 1 | Slot 2 | Slot 3 |
|---|---|---|---|
| Carbonate (A) | 25 | | 30 |
| Carbonate (D) | | 100 | 70 |
| Clay (C) | 75 | | |
| Latex | 13 | 10 | 11 |
| PVOH | 1.0 | 0.8 | 0.8 |
| Thickener (B) | 0.2 | 0.15 | 0.07 |
| Surfactant | 0.4 | | 0.2 |
| pH | 9.3 | 8.6 | 8.6 |
| Solids (%) | 60.1 | 70.0 | 62.3 |
| Density (g/cm$^3$) | 1.50 | 1.67 | 1.54 |
| Brookfield Viscosity [mPa · s] | 980 | 210 | 1120 |

Thickener (B) is added to the coatings to help prevent cratering. The trial speeds and coatweights for each layer for Example 7 are given in Table 11. The basepaper is a 75 g/m$^2$ wood-free paper with a surface roughness of 8.5 microns.

TABLE 11

| Speed [m/min] | Slot 1 coatweight g/m$^2$(dry) | Slot 2 coatweight g/m$^2$(dry) | Slot 3 coatweight g/m$^2$(dry) |
|---|---|---|---|
| 1200 | 1.5 | 5.5 | 3 |
| 1200 | 2.5 | 12.5 | 5 |

The coatings are crater free and had no other runnability issues. The 10 g/m$^2$ (dry) total coatweight coating has an uncalendered surface roughness of 5.52 μm and a calendered surface roughness of 2.1 μm. The 20 g/m$^2$ (dry) total coatweight coating has an uncalendered surface roughness of 3.95 μm and a calendered surface roughness of 1.3 μm. This demonstrates that the multilayer coating using a coarse pigment within the main coating layer can be easily applied with a curtain coater and can achieve a surface smoothness comparable to papers coated with much finer pigments.

What is claimed is:

1. A method of producing a coated paper or paperboard, but excluding photographic papers, comprising the steps of:

(a) forming a free flowing curtain comprising at least one layer, whereby a composition forming at least one layer of the free flowing curtain has a Shear-Thickening Index, defined as the ratio of the viscosity at 30,000 s$^{-1}$ to the viscosity at 3,000 s$^{-1}$ at 25° C., of at least about 1.2, and wherein at least one layer of the free flowing curtain has a solids content of at least about 30 wt. %, and (b) contacting the curtain with a continuous web substrate of basepaper and paperboard wherein the continuous web substrate has a velocity of at least about 400 m/min.

2. The method of claim 1, wherein at least one layer of the free flowing curtain of step (a) has, at a temperature of 25° C. and at a shear rate of 500,000 s$^{-1}$, a high shear viscosity of at least about 75 mPa·s.

3. The method of claim 1, wherein the free flowing curtain of step (a) is a multilayer free flowing curtain.

4. The method of claim 1, wherein the free flowing curtain of step (a) comprises a top layer ensuring printability.

5. The method of claim 1, wherein the free flowing curtain of step (a) comprises at least 3 layers.

6. The method of claim 1, wherein at least one layer of the free flowing curtain of step (a) comprises at least one pigment.

7. The method of claim 6, wherein the pigment is selected from the group consisting of clay, kaolin, calcined clay, co-structured pigments, talc, calcium carbonate, titanium dioxide, satin white, synthetic polymer pigment, zinc oxide, barium sulfate, gypsum, silica, alumina trihydrate, mica, and diatomaceous earth.

8. The method of claim 6, wherein the pigment comprises synthetic magadiite.

9. The method of claim 1, wherein at least one layer of the free flowing curtain of step (a) comprises at least one pigment having an aspect ratio of at least about 1.5:1.

10. The method of claim 1, wherein at least one layer of the free flowing curtain of step (a) comprises a binder.

11. The method of claim 10, wherein the binder is selected from the group consisting of styrene-butadiene latex, styrene-acrylate latex, styrene-butadiene-acrylonitrile latex, styrene-acrylate-acrylonitrile latex, styrene-butadiene-acrylate-acrylonitrile latex, styrene-maleic anhydride latex, styrene-acrylate-maleic anydride latex, polysaccharides, proteins, polyvinyl pyrrolidone, polyvinyl alcohol, polyvinyl acetate, cellulose derivatives and mixtures thereof.

12. The method of claim 1, wherein the free flowing curtain of step (a) has a solids content of at least about 40 wt. %.

13. The method of claim 1, wherein at least one layer of the free flowing curtain of step (a) comprises at least one optical brightening agent.

14. The method of claim 1, wherein the free flowing curtain of step (a) comprises at least 4 layers.

15. The method of claim 1, wherein at least one of the layers of the free flowing curtain of step (a) has a dry coatweight of less than about 10 g/m$^2$.

16. The method of claim 1, wherein the continuous web substrate of step (b) is neither precoated nor precalendered.

17. The method of claim 1, wherein the continuous web substrate of step (b) has a web velocity of at least about 300 m/min.

18. The method of claim 1, wherein the continuous web substrate of step (b) has a grammage of from about 20 to about 350 g/m$^2$.

19. The method of claim 1, wherein the free flowing curtain of step (a) comprises at least 5 layers.

20. The method of claim 1, wherein the free flowing curtain of step (a) comprises at least 6 layers.

21. The method of claim 1, wherein the continuous web substrate of step (b) has a web velocity of at least about 500 m/min.

22. The method of claim 1, characterized in that at least one layer of the free flowing curtain of step (a) comprises at least one surfactant.

23. The method of claim 1, wherein the continuous web substrate has a velocity of at least about 800 m/min.

24. The method of claim 1, wherein the continuous web substrate has a velocity of at least about 1000 m/min.

25. The method of claim 1, wherein the curtain is formed with a slot die.

26. The method of claim 1, wherein the curtain is formed with a slide die.

27. The method of claim 1, wherein at least one layer of the curtain comprises polyethylene oxide.

28. The method of claim 1, wherein the curtain comprises polyethylene oxide in the interface layer.

29. The method of claim 1 wherein the contacting in step b) is done under conditions such that the average shear rate at a line where the curtain contacts the substrate is at least 3,000 s$^{-1}$.

30. The method of claim 29 wherein the contacting in step b) is done under conditions such that the average shear rate at a line where the curtain contacts the substrate is at least 10,000 $s^{-1}$.

31. The method of claim 1 wherein at least one layer of the free flowing curtain of step (a) has, at a temperature of 25° C. and at a shear rate of 500,000 $s^{-1}$, a high shear viscosity of at least about 50 mPa·s.

32. A method of producing a coated paper or paperboard, but excluding photographic papers, comprising the steps of:

(a) forming a free flowing curtain comprising at least one layer, whereby a composition forming at least one layer of the free flowing curtain has a Shear-Blocking Behavior, and wherein at least one layer of the free flowing curtain has a solids content of at least about 30 wt. %, and (b) contacting the curtain with a continuous web substrate of basepaper and paperboard wherein the continuous web substrate has a velocity of at least about 400 m/min.

33. The method of claim 32 wherein the contacting in step b) is done under conditions such that the average shear rate at a line where the curtain contacts the substrate is at least 3,000 $s^{-1}$.

34. The method of claim 33 wherein the contacting in step b) is done under conditions such that the average shear rate a the line where the curtain contacts the substrate is at least 10,000 $s^{-1}$.

* * * * *